United States Patent [19]

Orr et al.

[11] 4,330,044

[45] May 18, 1982

[54] DRILL BIT

[75] Inventors: Thomas M. Orr, Greensburg; Paul V. Baker, Indiana, both of Pa.

[73] Assignee: ORR . . . Screw Machine Products, Inc., d.b.a. ORRCO, Greensburg, Pa.

[21] Appl. No.: 222,062

[22] Filed: Jan. 2, 1981

[51] Int. Cl.[3] ..... E21B 10/52

[52] U.S. Cl. ..... 175/410

[58] Field of Search ..... 175/410, 411, 320, 213

[56] References Cited

U.S. PATENT DOCUMENTS

| | | | |
|---|---|---|---|
| 2,971,409 | 2/1961 | Peters et al. | 77/68 |
| 3,010,345 | 11/1961 | Wagner | 77/68 |
| 3,032,129 | 5/1962 | Fletcher et al. | 175/410 |
| 3,089,552 | 5/1963 | Black et al. | 175/410 |
| 3,415,332 | 12/1968 | Bower, Jr. | 175/410 |
| 3,434,552 | 3/1967 | Bowen, Jr. | 175/410 |
| 3,434,553 | 3/1969 | Weller | 175/410 |
| 3,434,554 | 3/1969 | Bower, Jr. | 175/410 |
| 3,595,327 | 7/1971 | Self | 175/410 |
| 4,099,585 | 7/1978 | Emmerich | 175/320 |
| 4,190,125 | 2/1980 | Emmerich et al. | 175/410 |
| 4,190,128 | 2/1980 | Emmerich | 175/410 |

FOREIGN PATENT DOCUMENTS

| | | | |
|---|---|---|---|
| 160317 | 12/1954 | Australia | 175/410 |
| 196556 | 4/1923 | United Kingdom | 175/410 |
| 664983 | 1/1951 | United Kingdom | 175/410 |
| 669636 | 4/1952 | United Kingdom | 175/410 |

OTHER PUBLICATIONS

MTI-Mining Tools Inc. Advertisements re Dust Hog.

*Primary Examiner*—William F. Pate, III

*Attorney, Agent, or Firm*—Webb, Burden, Robinson & Webb

[57] ABSTRACT

A drill bit having a hollow shank, a cutting element and a mounting bridge supported in diametrically opposed cutouts at one end of the shank. The bridge is U-shaped in cross section with a base and spaced parallel legs perpendicular to the base. The cutting element is mounted in the bridge with the inner surfaces of the parallel legs of the bridge embracing a portion of each face of the cutting element and the bottom edge of the cutting element resting on the base of the bridge to support the cutting element against shear forces and against compression forces. The edge of the shank which supports the bridge is uneven throughout each 180° of its periphery on both sides of the diametrically opposed cutouts.

15 Claims, 8 Drawing Figures

DRILL BIT

BACKGROUND OF THE INVENTION

1. Field of the Invention

The invention relates generally to drill bits and more particularly to hollow drill bits having openings at the cutting end for supplying a fluid adjacent to the cutting element or for providing a vacuum adjacent to the cutting element and having a bridge supporting the cutting element.

2. Description of the Prior Art

Drill bits having openings at the cutting end to provide a fluid or a vacuum adjacent to the cutting element are known and examples of such drill bits are shown in U.S. Pat. Nos. 2,971,409; 3,010,345; 3,415,332; 3,434,553; 3,434,554; 4,099,585; 4,190,125 and 4,190,128. Additionally, the "DUST HOG" drill bit manufactured by Mining Tools Inc. located in Mentor, Ohio has such openings. In some of the above noted prior art drill bits the openings at the cutting end are located in a quadrant equaling approximately one-half the length of the opposite faces of the cutting element. In other prior art bits noted above the openings at the cutting end extend completely along each face of the cutting element. In all of these prior art drill bits the cutting element is brazed or otherwise fixed in place at the end of the bit in opposed slots cut in the end of the shank of the bit.

In bits having openings which extend only part way along the opposite faces of the cutting element the openings are not large enough to provide a sufficient quantity of fluid or a sufficient vacuum adjacent to the cutting element to achieve the desired drilling speed and efficiency. Drill bits having openings extending completely along the opposite faces of the cutting elements provide larger openings adjacent to the cutting element, but the cutting element is not adequately supported in the bit shank since it is only supported at its ends by the wall of the shank and there is inadequate backup support for the cutting element during drilling.

SUMMARY OF THE INVENTION

The hollow drill bit of the invention is an improvement over prior art drill bits since it has semicircular openings which extend completely along each face of the cutting element and includes a bridge for supporting the cutting element in the bit shank. The bridge is fixed in opposed slots in the end of the shank and provides support for the cutting element along its bottom edge as well as backup support for the portion of each face of the cutting element which lies behind a cutting edge during drilling which is approximately one-half of the surface of each face. The bit of the invention has the advantages of a bit with large openings for providing a fluid or a vacuum completely along each face of the cutting element while also providing support for the bottom edge of the cutting element during drilling. The portion of the bridge which backs up that portion of each face of the cutting element lying behind a cutting edge prevents fracture of the cutting element by shear forces during drilling and prevents destruction of the cutting element by compression caused by longitudinal forces as the bit is forced into material during drilling.

In one embodiment of the invention longitudinal slots are cut in the shank on opposite sides of the bridge and the cutting element in the portions of the shank which lead the cutting edges of the cutting element during drilling. These slots permit a large amount of fluid to be supplied to the cutting element which results in good chip and dust removal from the cutting element since packing of dust between the faces of the cutting element and the shank is substantially eliminated. In another embodiment of the invention the end of the shank on both sides of the bridge and the cutting element is formed in the shape of a depressed sine wave with the lower portion of each sine wave located on the portions of the edge of the shank which lead the cutting edges of the cutting element during drilling.

A primary use of the drill bit of the invention is to drill holes in mine roofs to receive roof bolts and in drilling such holes, the drill bit is mounted on the upper end of a hollow drill steel. For this purpose an acircular socket having a circular or an acircular cross section is formed on the end of the shank opposite the end carrying the bridge which supports the cutting element. One type of attachment arrangement which may be provided between the socket portion of the shank and a drill steel is described in copending application Ser. No. 203,494, filed Nov. 3, 1980.

An object of the invention is to provide a hollow drill bit having openings for providing a fluid or a vacuum adjacent to the cutting element and to provide a bridge for supporting the cutting element in the shank with good strength during drilling. Another object is to provide a drill bit wherein the contour of the end of the shank adjacent to the cutting element permits good dust and chip removal to increase drilling speed and efficiency.

DESCRIPTION OF THE PREFERRED EMBODIMENTS

Figure 1:
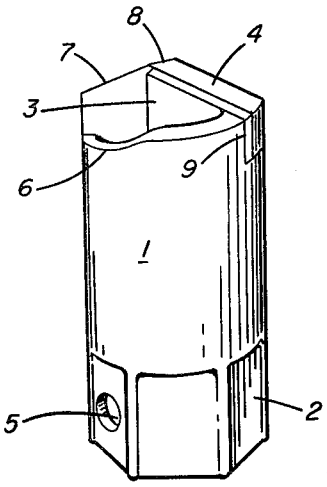
FIG. 1 is a perspective view of a drill bit according to one embodiment of the invention.

A drill bit according to the invention has a hollow shank 1 with a socket portion 2 at one end and a bridge 3 which supports a cutting element 4 at the other end. The cutting element may be made of tungsten carbide or other suitable material as is well known to those skilled in the art. The socket portion 2 may be hexagonal in cross section and is adapted to receive the hexagonal end of a hollow drill steel (not shown). While a hexagonal socket portion is shown, it will be understood by those skilled in the art that other shapes in horizontal cross section may be used so long as the socket portion of the drill bit conforms in cross section with the cross section of a hollow drill steel so that the socket portion will fit over the drill steel. A hole 5 is formed in socket portion 2 to receive a pin or spring clip (not shown) which will fit into an opening or a groove in a drill steel to retain the drill bit on the drill steel.

Figure 2:
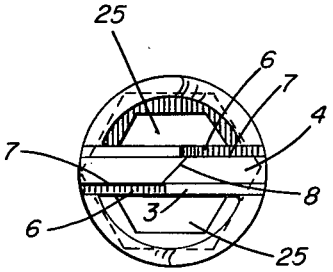
FIG. 2 is a top view of the drill bit shown in FIG. 1.

In the embodiment of FIGS. 1 and 2, the edge of the shank adjacent to bridge 3 and cutting element 4 is formed in the shape of flattened or depressed sine wave on both sides of the cutting element. The lower portion 6 of each depressed sine wave is located adjacent to an exposed portion of a face of cutting element 4 so that it will be ahead of a cutting edge 7 of cutting element 4 as the bit rotates in order to lead the cutting edge during drilling. The upper end of the cutting element is triangular in profile with a central apex 8.

Figure 5:
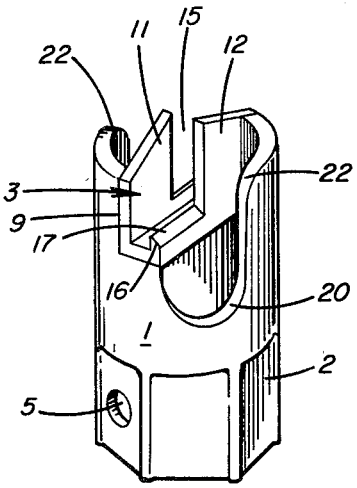
FIG. 5 is a perspective view of a drill bit according to the embodiment of FIG. 3 with the cutting element removed.
Figure 6:
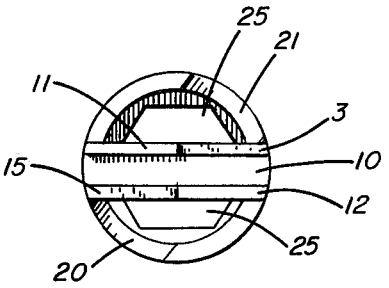
FIG. 6 is a top view of the drill bit shown in FIG. 5.
Figure 7:
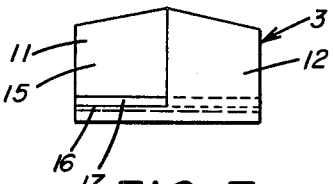
FIG. 7 is a side view of the bridge shown in FIGS. 1–6.
Figure 8:
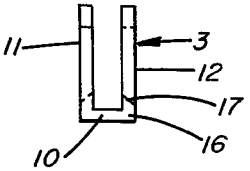
FIG. 8 is an end view of the bridge shown in FIG. 7.

Cutting element 4 is held in bridge 3 by brazing or by other well known means. Each end of bridge 3 is supported in a cutout 9 formed in the end of the shank and the bridge is welded to the shank to hold it in position. The bridge is shown in detail in FIGS. 5–8 without a cutting element supported therein and is U-shaped in cross section with a base 10 and upstanding legs 11 and 12. Each leg is formed with a center apex which corresponds with the center apex 8 of cutting element 4 when the cutting element is supported in the bridge. The upwardly extending legs 11 and 12 slightly embrace opposite faces of the cutting element supported in bridge 3 to impart strength to the cutting element and prevent shear by horizontal forces during drilling. As shown in FIGS. 5 and 7, each leg of bridge 3 has a right angle cutout 15 which is equal to approximately one-half of the length of the bridge. Each cutout 15 is located on the portion of the bridge leg next to that portion of a face of cutting element 4 which has its upper edge exposed to form a cutting edge 7. The lower edge 16 of each cutout 15 is formed with a downwardly directed chamfer 17 which assists in the removal of debris during cutting and prevents separation of a face of cutting element 4 and the corresponding leg of the bridge. The bottom edge of cutting element 4 abuts the upper surface of base 10 of the bridge to provide vertical support for the cutting element.

In the embodiment shown in FIGS. 3–6, like reference numerals are used with like parts in the embodiment shown in FIGS. 1 and 2. In this embodiment the edge of shank 1 is formed with a pair of elongated longitudinal notches 20 and 21 which replace the lower portions 6 of the depressed sine waves at the edge of the shank. The elongated longitudinal notches are angularly offset from each other by approximately 180° and are located in the shank ahead of the exposed portions of the cutting element to lead the cutting edges 7 during drilling in order to assist in dust and chip removal. The juncture of the edge of shank 1 and the wall of each of notches 20 and 21 is formed with a rounded corner 22 which facilitates the dust and chip removal.

Figure 4:
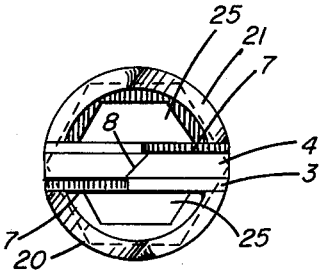
FIG. 4 is a top view of the drill bit shown in FIG. 3.

As shown in FIGS. 2 and 4, the bridge and the cutting element mounted therein extend completely across the end of the shank with the ends of both being substantially flush with the outer surface of the shank. An opening 25 having a substantially semicircular cross section is formed at the end of shank 1 on each side of bridge 3 and cutting element 4 between the interior surface of the shank and the exterior surfaces of legs 10 and 11 of bridge 3. These semicircular openings permit the supply of a fluid or the creation of a vacuum adjacent to cutting element 4.

In order to compare drill bits according to the invention with a prior art drill bit, comparative tests were run using drill bits as shown in the embodiments in FIGS. 1 and 2 and FIGS. 3 and 4 of the application and standard industry Dust Hog drill bits. As shown by the tables set forth hereinafter, drill bits according to both embodiments of the invention were run under vacuum and using water as were the Dust Hog bits.

The data set forth in Table I is the result of test conducted in a mine roof consisting of 18 inches of sandstone; a 4 inch clay vein, 12 inches sandstone, a 4 inch clay vein and sandstone for the remainder of the 4 foot holes. The sandstone was comprised of 60% quartz. Drilling was carried out with an F.M.C. drilling machine and pressurized water was forced through the drill steel and the hollow bit to wash away the cuttings. The drill was rotated at 90–100 rpm and the boom pressure varied between 700 and 1200 psi. A starter drill steel was used to drill the first 2 feet of each hole and a finish drill steel was used for the remaining 2 feet of each hole where the holes were 4 feet in depth.

TABLE I

| Hole Depth-Ft. | Time-Sec. | Times Bit Cleaned |
|---|---|---|
| 1" new bit according to invention (FIGS. 1 and 2) - pressurized water | | |
| 4 | 65 | 0 |
| 4 | 68 | 0 |
| 4 | 68 | 0 |
| 2 | 35 | 0 |
| 2 | 40 | 1 |
| 2 | 30 | 0 |
| 2 | 38 | 0 |
| 2 | 45 | 1 |
| 2 | 35 | 0 |
| 2 | 30 | 0 |
| 2 | 38 | 0 |
| 2 | 38 | 0 |
| 2 | 40 | 0 |
| 2 | 35 | 0 |
| 2 | 42 | 0 |
| 2 | 38 | 0 |
| 2 | 35 | 0 |
| Average time to drill 1 foot - 18 sec. | | |
| Dust Hog 1" new bit - pressurized water | | |
| 4 | 90 | 2 |
| 4 | 85 | 2 |
| 4 | 95 | 3 |
| 4 | 80 | 2 |
| Average time to drill 1 foot - 21.9 sec. | | |

The data set forth hereinafter in Table II is the result of tests conducted in a mine roof consisting of slate with a three to four inch streak of sand rock containing 92% quartz. Drilling was done with an F.M.C. drilling machine and a vacuum was provided at the bit to remove cuttings. A starter drill steel was used to drill the first 2 feet of each hole and a finishing drill steel was used to drill the remaining 2 feet where the holes were 4 feet in depth.

TABLE II

| Hole Depth-Ft. | Time-Sec. | Times Bit Cleaned |
|---|---|---|
| 1" reground bit according to the invention (FIGS. 1 and 2) - vacuum | | |
| 2 | 55 | 1 |
| 2 | 35 | 0 |
| 2 | 35 | 0 |
| 2 | 30 | 0 |
| 2 | 35 | 0 |
| 2 | 40 | 0 |
| 2 | 30 | 0 |
| 2 | 50 | 1 |
| 2 | 35 | 0 |
| 2 | 38 | 0 |
| 2 | 42 | 0 |
| 2 | 55 | 1 |
| 4 | 55 | 0 |
| 4 | 65 | 1 |
| 4 | 48 | 0 |
| 4 | 50 | 0 |
| 4 | 50 | 0 |
| 5 | 75 | 1 |

TABLE II-continued

| Hole Depth-Ft. | Time-Sec. | Times Bit Cleaned |
|---|---|---|
| 4 | 60 | 0 |
| 4 | 65 | 0 |
| Average time to drill 1 foot - 16.6 sec. | | |
| 1" new bit according to the invention (FIGS. 3 and 4) - vacuum | | |
| 5 | 80 | 1 |
| 4 | 70 | 1 |
| 4 | 73 | 0 |
| 40 | —* | 0 |
| *Roof turned soft - no time recorded | | |
| Average time to drill 1 foot - 17.2 sec. | | |
| Dust Hog 1" new bit - vacuum | | |
| 2 | 62 | 2 |
| 2 | 65 | 2 |
| 2 | 55 | 1 |
| 2 | 55 | 1 |
| 4 | 75 | 2 |
| 3 | —* | — |
| *Bit plugged and destroyed | | |
| Average time to drill 1 foot - 26 sec. | | |

All of the times set forth in Tables I and II to drill an individual hole include the time required to clean the bit. Cleaning of each bit when necessary was accomplished without removing the bit from the hole by hammering on the drill steel to vibrate the bit and thereby shake loose material clogging in the bit.

It will be seen from the data in Table I that the drill bit according to FIGS. 1 and 2 of the invention when used with pressurized water drills 1 foot in an average of 18 seconds, whereas the Dust Hog drill bit when used with water drills 1 foot in an average of 21.9 seconds. An improvement of almost 4 seconds per foot is effected by using a drill bit according to the embodiment of FIGS. 1 and 2 of the invention with water. It will be realized by those skilled in the art that such an improvement is substantial when drilling a large number of holes.

Figure 3:
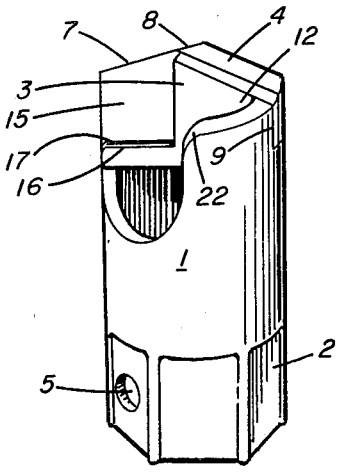
FIG. 3 is a perspective view of a drill bit according to a second embodiment of the invention.

The data in Table II shows that the bit of FIGS. 1 and 2 of the invention when used with a vacuum at the drill bit will drill 1 foot in an average of 16.6 seconds and the drill bit of FIGS. 3 and 4 of the invention when used with a vacuum will drill 1 foot in an average of 17.2 seconds. When the Dust Hog bit is used with a vacuum it can drill a 1 foot hole in an average of 26 seconds. A substantial improvement is achieved by utilizing a drill bit according to the invention with both water and a vacuum as compared with the Dust Hog bit under the same conditions.

Drill bits according to the invention have good strength because the bottom edge of the cutting element is supported by the bottom 10 of bridge 3 and the vertical forces opposite cutting edges 7 are backed up by the legs 11 and 12 of bridge 3. The semicircular openings 25 adjacent to the bridge and the cutting element permit a fluid or a vacuum to be provided along the full length of the cutting element on both sides thereof which results in rapid and efficient drilling. Furthermore, openings extending completely along both faces of the cutting element make it possible to supply a greater quantity of fluid to the cutting edges of the cutting element than in prior art bits which results in rapid removal of dust and swarf and efficient drilling. Additionally, the depressed portions of the edge of the shank permit efficient removal of dust which otherwise tends to become clogged and impacted in the bit. The bridge carrying the cutting element makes it less likely that the cutting element will fracture during drilling and, therefore, it is not necessary to replace the drill bit on the drill steel as often as with prior art drill bits.

While preferred embodiments of the invention have been described, it will be understood that the invention may be embodied within the scope of the appended claims.

We claim:

1. A drill bit having a hollow shank, a cutting element with spaced substantially parallel faces, and a mounting bridge for said cutting element, one end of said shank being formed with diametrically opposed cutouts, said bridge being substantially U-shaped in cross section with a base and spaced parallel legs perpendicular to said base, said bridge extending across said shank and supported at the end of said shank in said cutouts, said cutting element supported in said bridge with the longitudinal axis of said cutting element parallel to the longitudinal axis of said bridge, the inner surfaces of said spaced parallel legs of said bridge embracing at least a portion of each face of said cutting element and the full length of the bottom edge of said cutting element resting on said base, whereby said cutting element is supported in said bridge to resist shear forces and compression forces.

2. A drill bit as set forth in claim 1 wherein each leg of said bridge has a substantially right angle cutout portion extending along approximately one-half of the length of said leg.

3. A drill bit as set forth in claim 2 wherein said cutting element is formed with a triangular upper portion having a central apex, a cutting edge on each side of said cutting element extending from said central apex along a portion of the edge of one of said faces, said cutout portion on each of said legs being complementary with the edge of each face forming said cutting edge.

4. A drill bit as set forth in claims 2 or 3 wherein the bottom edge of said cutout portion in each of said legs is chamfered at an angle depending downwardly away from the adjacent face of said cutting element.

5. A drill bit as set forth in claim 1 wherein said one end of said shank is formed with an uneven edge throughout each 180° of its periphery, each of said uneven edges extending between said diametrically opposed cutouts in said one end of said shank, a portion of each uneven edge of said one end of said shank being lower than another portion of each uneven edge of said one end of said shank.

6. A drill bit as set forth in claim 5 wherein said portion of each of said uneven edges of said one end of said shank extends for approximately 90° of the periphery of said one end of said shank.

7. A drill bit as set forth in claims 5 or 6 wherein each of said uneven edges is in the shape of a depressed sine wave.

8. A drill bit as set forth in claims 5 or 6 wherein each of said uneven edges is formed with an elongated notch extending longitudinally of said shank.

9. A holder for a cutting element comprising a hollow shank and an elongated mounting bridge adapted to support an elongated cutting element, one end of said shank being formed with diametrically opposed cutouts, said bridge being substantially U-shaped in cross section with a base and spaced parallel legs extending substantially perpendicularly from said base along at least approximately one-half the length of said base, said elongated bridge extending across said shank with opposite ends of said base supported in said cutouts, whereby said bridge is adapted to support the complete lower edge and at least a portion of the faces of a cutting element to resist shear forces and compression forces.

10. Apparatus as set forth in claim 9 wherein each leg of said bridge has a cutout portion extending along approximately one-half of the length of said leg.

11. Apparatus as set forth in claims 9 or 10 wherein the bottom edge of said cutout portion in each of said legs is chamfered at an angle depending downwardly toward the outer surface of the leg in which said cutout portion is located.

12. Apparatus as set forth in claim 9 wherein said one end of said shank is formed with an uneven edge throughout each 180° of its periphery, each of said uneven edges extending between said diametrically opposed cutouts in said one end of said shank, a portion of each uneven edge of said one end of said shank being lower than another portion of each uneven edge of said one end of said shank.

13. Apparatus as set forth in claim 12 wherein said portion of each of said uneven edges of said one end of said shank extends for approximately 90° of the periphery of said one end of said shank.

14. Apparatus as set forth in claims 12 or 13 wherein each leg of said bridge has a cutout portion extending along approximately one-half of its length, each of said uneven edges is in the shape of a depressed sine wave and the lower portion of each of said sine waves is that portion of an uneven edge located adjacent to a cutout portion in one of said legs and is angularly spaced approximately 90° from the lower portion of the other sine wave.

15. Apparatus as set forth in claims 12 or 13 wherein each leg of said bridge has a cutout portion extending along approximately one-half of its length, each of said uneven edges is formed with an elongated notch extending longitudinally of said shank and each of said notches is located adjacent to a cutout portion in one of said legs and is angularly spaced approximately 90° from the other notch.

* * * * *